US011395538B1

(12) United States Patent
Senn

(10) Patent No.: US 11,395,538 B1
(45) Date of Patent: Jul. 26, 2022

(54) SYSTEMS AND METHODS ASSOCIATED WITH A CONTAINER HOLDER

(71) Applicant: Kevin Senn, Harris, TX (US)

(72) Inventor: Kevin Senn, Harris, TX (US)

( * ) Notice: Subject to any disclaimer, the term of this patent is extended or adjusted under 35 U.S.C. 154(b) by 0 days.

(21) Appl. No.: 17/237,790

(22) Filed: Apr. 22, 2021

(51) Int. Cl.
*A45F 5/02* (2006.01)

(52) U.S. Cl.
CPC ..... *A45F 5/021* (2013.01); *A45F 2200/0583* (2013.01)

(58) Field of Classification Search
CPC ..... A44D 2203/00; A45C 13/1069; F16B 2001/0035; A44B 11/258; A44B 11/2592
USPC ..... 224/183, 271–272
See application file for complete search history.

(56) References Cited

U.S. PATENT DOCUMENTS

| | | | | |
|---|---|---|---|---|
| 6,530,510 | B2 * | 3/2003 | Ferrari | B60R 11/00 224/555 |
| 6,905,051 | B2 * | 6/2005 | Chee | A45F 5/00 224/665 |
| 7,496,994 | B1 * | 3/2009 | Headley | F16B 45/00 24/697.2 |
| D603,248 | S * | 11/2009 | Bar-Erez | D8/373 |
| 9,936,772 | B2 * | 4/2018 | Paik | A45F 3/047 |
| 10,913,593 | B2 * | 2/2021 | Adjeleian | A47G 23/02 |
| 2010/0294816 | A1 * | 11/2010 | Sentell | A45F 5/02 224/148.3 |
| 2011/0233354 | A1 * | 9/2011 | Mitchell | A47G 23/0225 29/428 |

* cited by examiner

*Primary Examiner* — Adam J Waggenspack
(74) *Attorney, Agent, or Firm* — Pierson Intellectual Property LLC

(57) ABSTRACT

A container holder with a smaller profile when in use and not in use.

10 Claims, 13 Drawing Sheets

SYSTEMS AND METHODS ASSOCIATED WITH A CONTAINER HOLDER

BACKGROUND INFORMATION

Field of the Disclosure

Examples of the present disclosure are related systems and methods associated with a container holder. More specifically, embodiments are directed towards a container holder with a first portion that is configured to be coupled to an article of clothing and a second portion that is configured to be embedded within a beverage sleeve, wherein the first portion and the second portion are configured to be magnetically and mechanically coupled together.

Background

A water bottle is a container that is used to hold water, liquids, or other beverages for consumption. A water bottle allows an individual to transport and drink a beverage at multiple locations.

Conventionally to transport water bottles, a user can either hold the water bottle in their hand or user a bottle holder. However, holding a water bottle requires one of the user's two hands to carry the water bottler. Situations can arise where it is burdensome for a user to relinquish one of their hands to carry the water bottle. Alternatively, using a bottle holder to transport water bottles can be cumbersome and require ample space regardless of if they are in use or not.

Accordingly, needs exist for more effective and efficient systems and methods for a container holder with a first portion that is configured to be coupled to an article of clothing and a second portion that is configured to be embedded within a beverage sleeve, wherein the first portion and the second portion are configured to be magnetically and mechanically coupled together.

SUMMARY

Embodiments disclosed herein describe systems and methods for a container holder that incorporates a first portion that is configured to be selectively coupled to a second portion. The first portion may be associated with a clip that is configured to be attached to a user's article of clothing, and the second portion may be configured to be embedded within a beverage sleeve. In use, user may align a magnetized projection of the second portion with a magnetized depression of the first portion to couple the first and second portions together. Furthermore, the second portion may include an overhang that is configured to be positioned over a lip of the first portion, which may mechanically support the coupling of the first portion with the second portion.

The first portion may include a front face, depression, lip, and window.

The front face may be a curved front face, wherein a lower portion of the front face is thicker than an upper portion of the front face. This may limit a profile created by the container holder, while also increasing a surface area of the front face. The front face may be configured to be positioned adjacent to an inner surface of the second portion when the first portion and the second portion are coupled together.

The depression may extend from the front face towards a rear face of the front portion, and have a substantially circular face and slanted sidewalls. The depression may be magnetized with a first polarity, which may be configured to couple with a projection of the second portion that has a second polarity. The slanted sidewalls of the depression may not be uniform around a circumference of the circular face of the depression. The non-uniformity of the slanted sidewalls may be caused by the curvature of the front face. As such, a first angle of the slanted sidewall may be sharper at a lower portion of the front face in compared to a second angle of the slanted sidewall at an upper portion of the slanted sidewall, wherein the angle of the slanted sidewall may gradually change from the first angle to the second angle. This change in curvature may increase a total surface area between the first portion and second portion, while also increasing a mechanical support caused by the lower portion of the front face against the projection of the second portion.

The lip may extend from the front face towards a rear surface of the front portion. This may create a ledge between a first side of the front portion and a second side of the front portion. The window may be a cutout within the front face to reduce a thickness of the lip that is aligned with the circular face. This may enable an overhang associated with the second portion to be secured over the lip.

The second portion may be configured to be embedded within a beverage sleeve, and be selectively coupled with the first portion. The second portion may include an outer face, inner projection, inner sidewall, overhang, and tab.

The outer face may be a substantially curved face that is configured to be positioned adjacent or next to an outer surface of a beverage within a beverage sleeve. In embodiments, the curvature of the curved front face may be concave, and correspond to the curvature of a beverage bottle or can.

The inner projection may be positioned on an inner face of the second portion, and extend away from the inner face. The inner projection may be substantially cylindrical in shape, and may be magnetized with a second polarity. The inner projection may be configured to be inserted into the depression of the first portion.

The inner sidewall may be positioned more proximate to the outer face than the inner projection, and be configured to be positioned adjacent to the front face of the first portion when the first portion and the second portion are coupled together. The relative positioning of the inner projection and the inner sidewall may create a ledge on the curved surface of the inner projection, wherein the curved surface may be positioned adjacent to the sidewalls of the depressions to increase the surface area between the first portion and the second portion.

The overhang may be positioned on an upper surface of the second portion, and may extend in a plane that is perpendicular the outer face. The overhang may extend in the same direction as the inner projection. The overhang may extend from the inner sidewall past a plane that is vertically aligned with the face of the inner projection. This may create a slot that enables portion of the tab to be positioned adjacent to a rear face of the first portion, the lip of the first portion to be positioned adjacent to the overhang, and the inner projection to be embedded and positioned within the depression.

The tab may be positioned on an end of the overhang, and may be shaped similar to an "S" with a convex curve and a concave curve. The curvature of the tab may enable a tight fitting between the second portion and the first portion, while enabling an end of the overhang to be positioned away from the rear face of the second portion.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
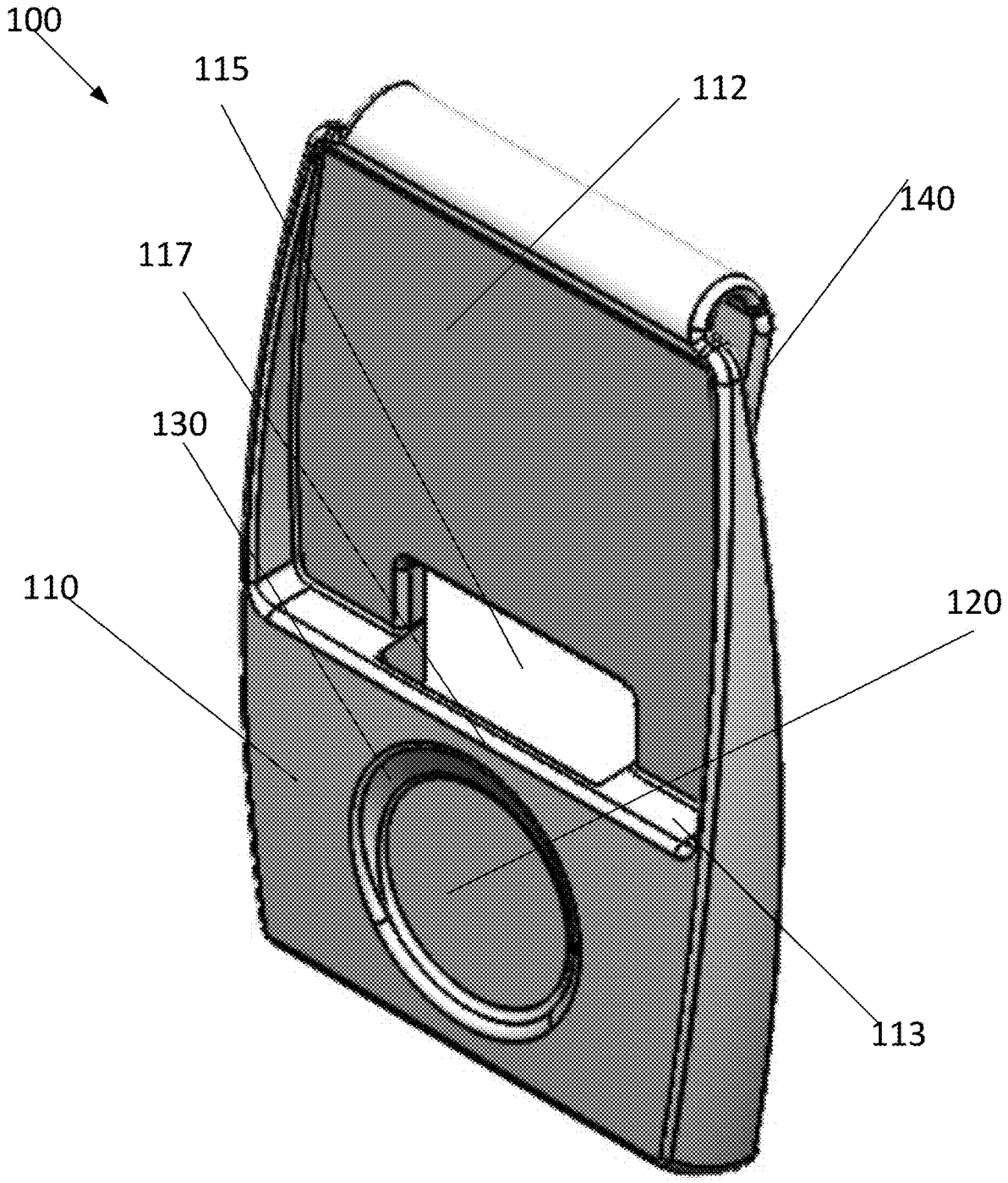
FIG. 1-5 depict a first portion of a container holder, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments described herein disclose a container holder with a first portion and a second portion. The first portion may be configured to be positioned on a user's article of clothing, and the second portion may be positioned adjacent to a beverage. Utilizing magnets and mechanical coupling mechanisms, the first portion and the second portion may be selectively coupled together.

FIG. 1 depicts a first portion 100 for a container holder, according to an embodiment. First portion 100 may include a first front face 110, second front face 112, ledge 113, window 115, lip 117, depression 120, and clip 140.

First front face 110 and second front face 112 may form a front surface of first portion 100 of the container holder. First front face 110 and second front face 112 may form a curved, sloped, etc. front surface of first portion 100. Front face 110 may be positioned below second front face 112, and first front face 110 and second front face 112 may be laterally offset from each other, such that the two faces do not form a continuous surface. The curvature of first front face 110 may cause a lower portion of first front face 110 to be thicker than an upper portion of first front face 110. This may limit a profile created by the container holder, while also increasing a surface area of first front face 110.

Ledge 113 may be positioned at an upper end of first front face 110 and a lower surface of second front face 112, wherein ledge 113 extends in a direction perpendicular to a central axis of first portion 110. Ledge 113 may create a shelf, bracket, etc. positioned between first front face 110 and second front face 112. Window 115 may be a cutout, opening, orifice, etc. positioned within second front face 112 and ledge 113 without extending into first front face 110. Window 115 may cause a thickness of ledge to decrease along portions of ledge 113 that are positioned within a middle of ledge 113. This decrease in thickness may create lip 117 along an upper rim of first front face 110. In embodiments, lip 117 may be configured to receive an overhang on second portion 600 of container holder. By reducing the thickness of ledge 113 to lip 117, an inner profile of first front face 110 may be reduced. This may enable a tab associated with second portion 600 to not increase the inner profile associated with first front face 110, and not extend past a plane defined by an inner profile of first portion 100. In other words, the reduction of thickness may cause the tab of second portion 600 to not poke a user wearing first portion 100.

Depression 120 may be positioned on first front face 110. Depression 120 may extend from an outer profile of first front face 110 towards the inner profile of first front face 110. Depression 110 may have a substantially circular surface with slanted sidewalls 130.

Depression 120 may be magnetized with a first polarity, which may be configured to couple with a projection 710 of the second portion 600 that has a second polarity. The slanted sidewalls 130 of depression 120 may not be uniform around a circumference of the circular face of depression 120. The non-uniformity of slanted sidewalls 130 may be caused by the curvature of first front face 110. As such, a first angle of the slanted sidewall 130 may be sharper at a lower portion of first front face 110 in compared to a second angle of the slanted sidewall 130 at an upper portion of the slanted sidewall 130, wherein the angle of the slanted sidewall 130 may gradually change from the first angle to the second angle. This change in curvature may increase a total surface area between the first portion 100 and second portion 600, while also increasing a mechanical support caused by the lower portion of the front face against the projection of the second portion.

Clip 140 may be positioned on a rear surface of first portion 100, and be configured to allow first portion 100 to be attached and detached from a belt, waistband, etc. Clip 140 may include a projection that extends from an upper edge of first portion 100 towards a lower surface of the container holder. A first end of clip 140 may be permanently positioned on the upper edge of first portion 100. A second end of clip 140 may be configured to move from a position adjacent to the rear surface of first portion 100 to a position away from the rear surface of first portion 100. Responsive to sliding the projection around the belt of the user, the belt may move the second end of the projection away from the rear surface of first portion 100. Then, clip 140 may apply pressure towards the rear surface of first portion 100. This pressure may secure first portion 100 to the belt.

Figure 2:
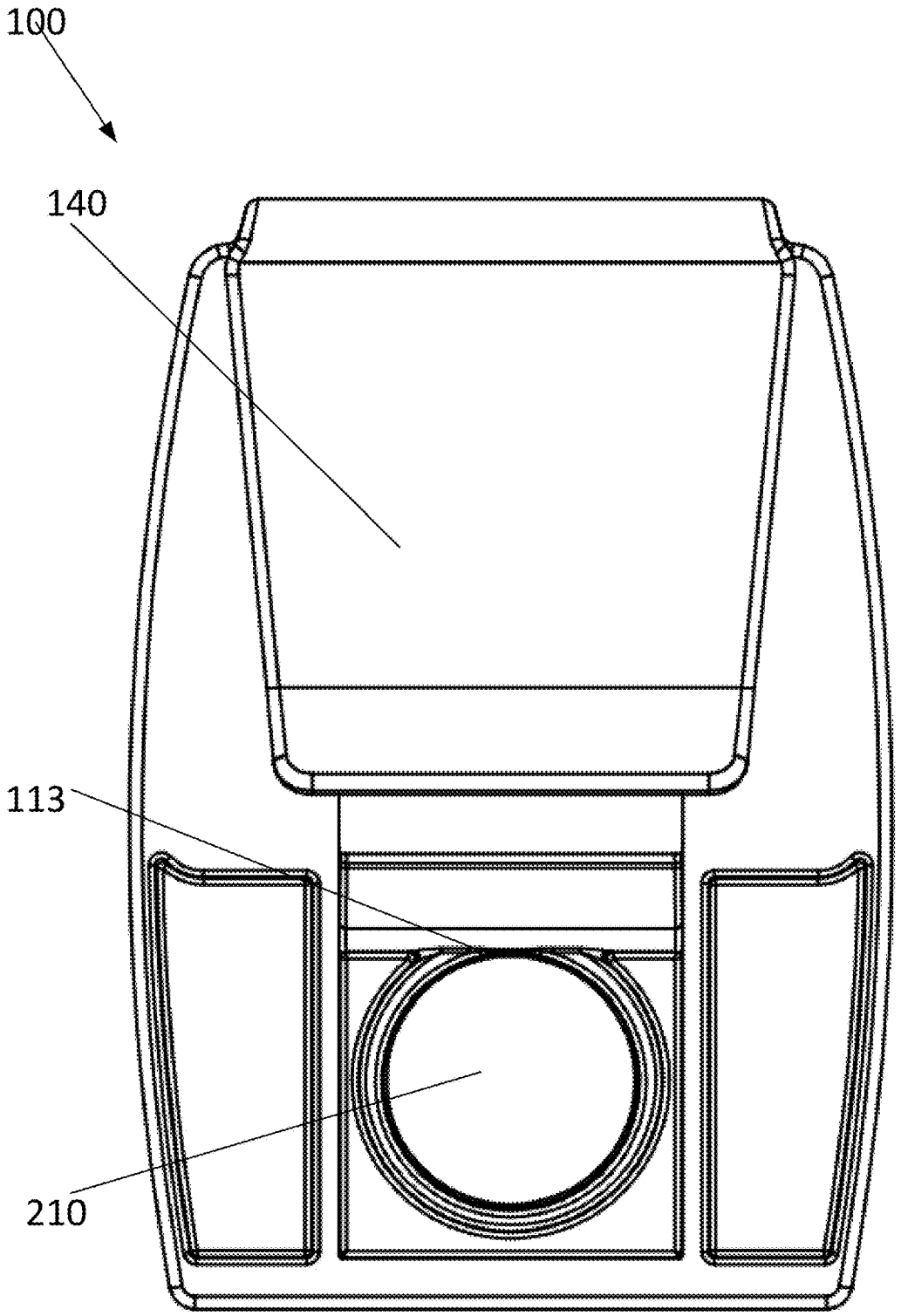

FIG. 2 depicts a rear view of elements of first portion 100, according to an embodiment. Elements depicted in FIG. 2 may be described above. For the sake of brevity, a further description of these elements is omitted.

As depicted in FIG. 2, the rear face 210 of depression 120 may be substantially circular. Further as shown in FIG. 2, the tapering of sidewalls 113 may be different along the circumference of depression 120.

Figure 3:
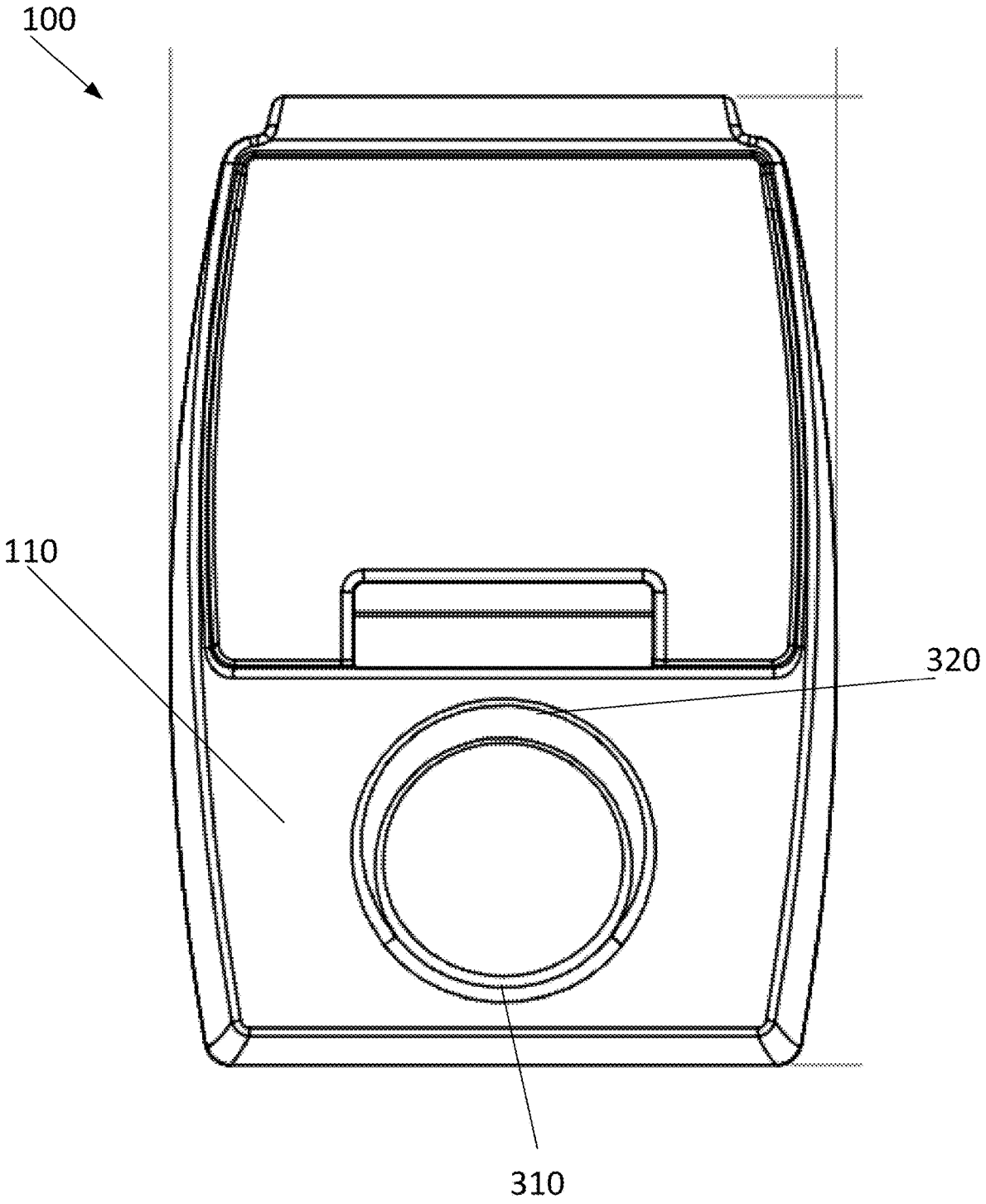

FIG. 3 depicts a front view of elements of first portion 100, according to an embodiment. Elements depicted in FIG. 3 may be described above. For the sake of brevity, a further description of these elements is omitted.

As depicted in FIG. 3, the upper portions 320 of sidewalls 113 may have a less sharp angle than those or lower portions 310 of sidewalls 113.

Figure 4:
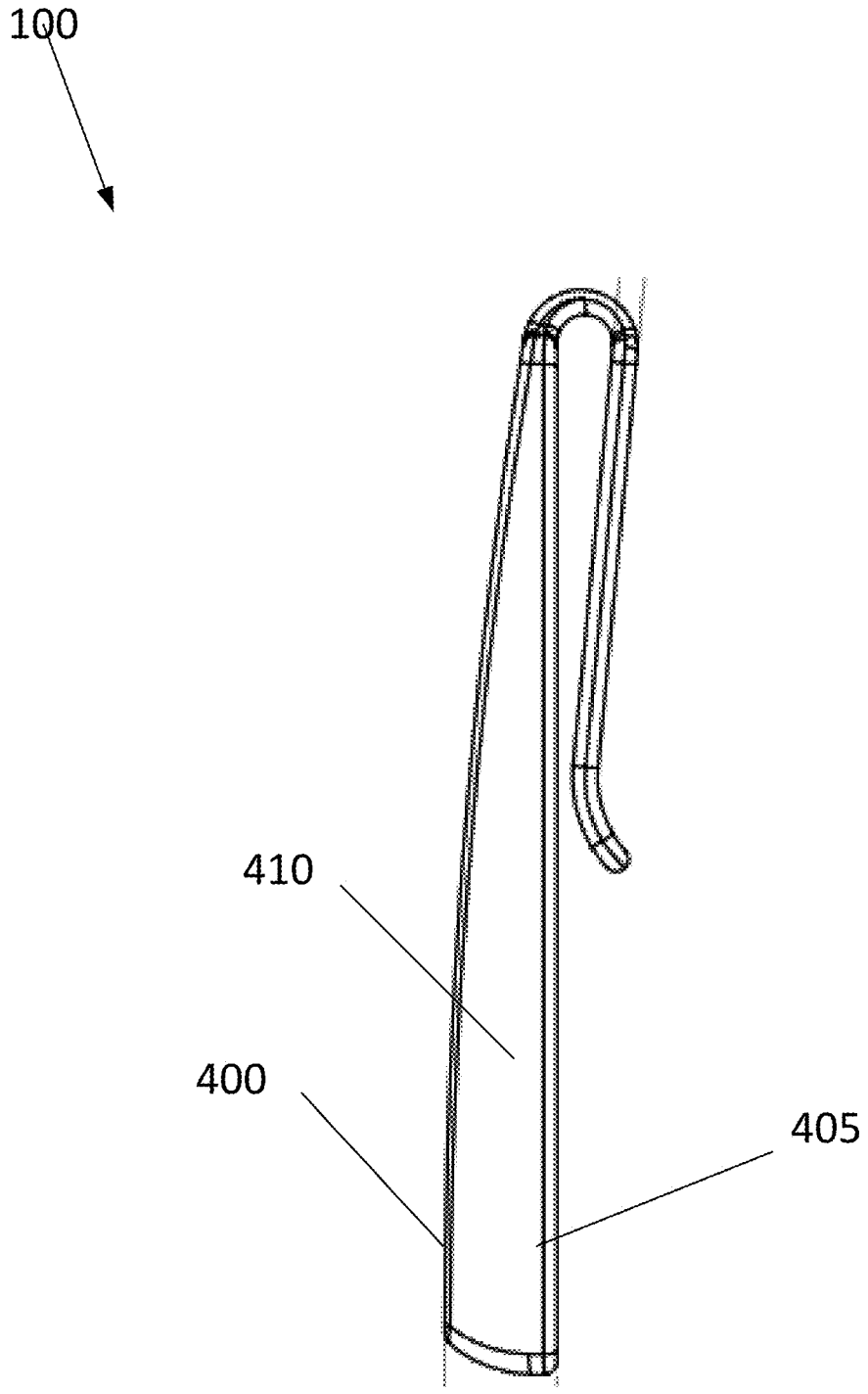

FIG. 4 depicts a side view of elements of first portion 100, according to an embodiment. Elements depicted in FIG. 4 may be described above. For the sake of brevity, a further description of these elements is omitted.

As depicted in FIG. 4, first portion 100 may have sidewalls 410 that have a tapered front surface and a planar rear surface. This may decrease the front profile 400 of first portion 100, and enable a rear profile 405 of first portion to be positioned directly adjacent to a user.

Figure 5:
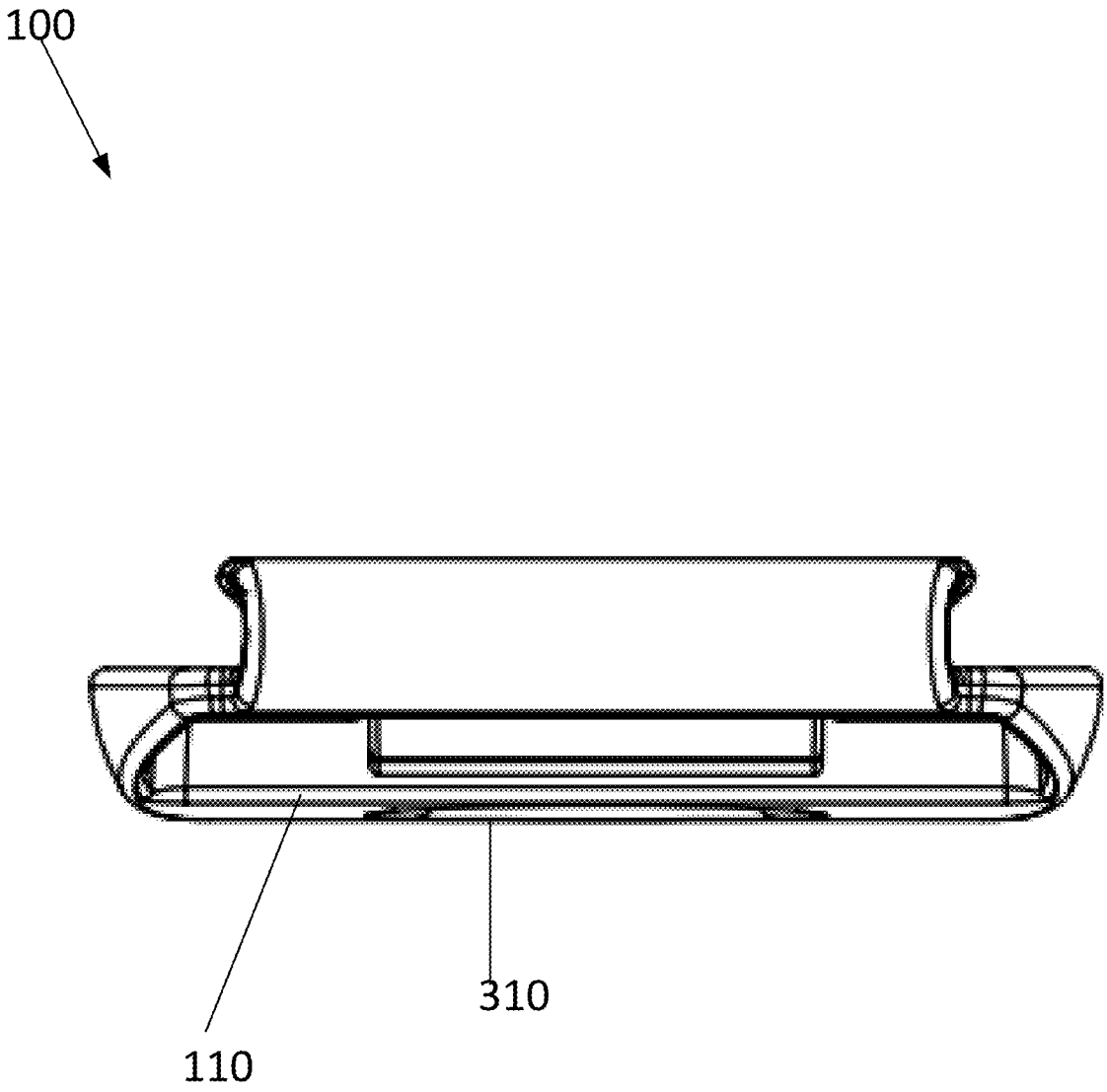

FIG. 5 depicts a top view of elements of first portion 100, according to an embodiment. Elements depicted in FIG. 5 may be described above. For the sake of brevity, a further description of these elements is omitted.

Figure 6:
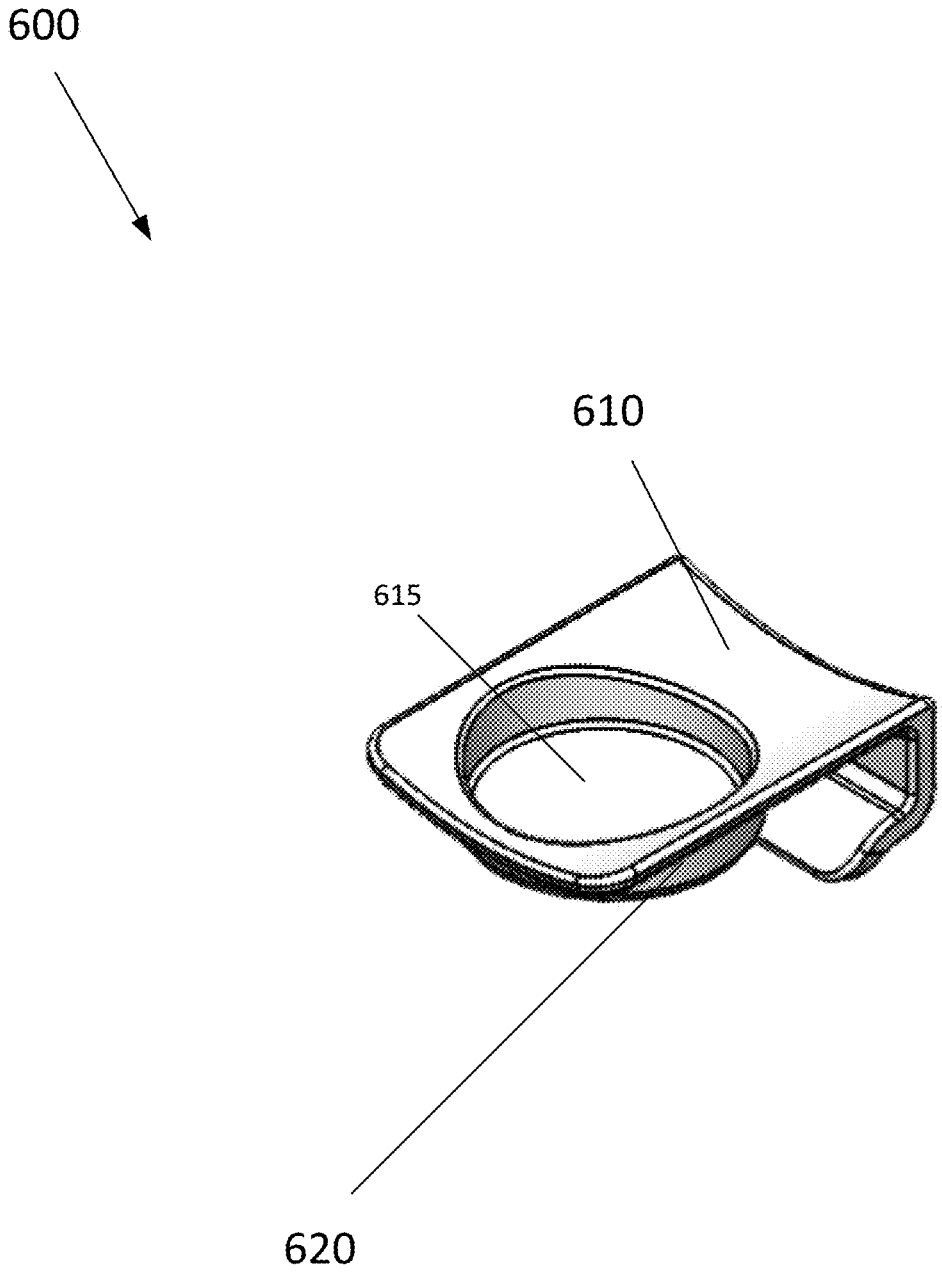
FIG. 6-9 depict a second portion of a container holder, according to an embodiment.

FIG. 6 depicts a perspective view of elements of second portion 600, according to an embodiment. Second portion 600 may be configured to be embedded within a beverage sleeve or affixed directly to a beverage.

Second portion 600 may have a curved front face 610. Front face 610 may be configured to be positioned adjacent or next to an outer surface of a beverage within a beverage sleeve. In embodiments, the curvature of the front face 110 may be concave, and correspond to the curvature of the beverage bottle or can.

Second portion 600 may also include a projection 620. Projection 620 may be positioned on front face 610 of second portion 600, and extend away from the front face. Projection 620 may be substantially cylindrical in shape, and may be magnetized with a second polarity. Projection 620 may be configured to be inserted into the depression of the first portion. In embodiments, projection 620 may have a hollow interior 615, which may be advantageous for a user to determine a location of projection 620.

Figure 7:
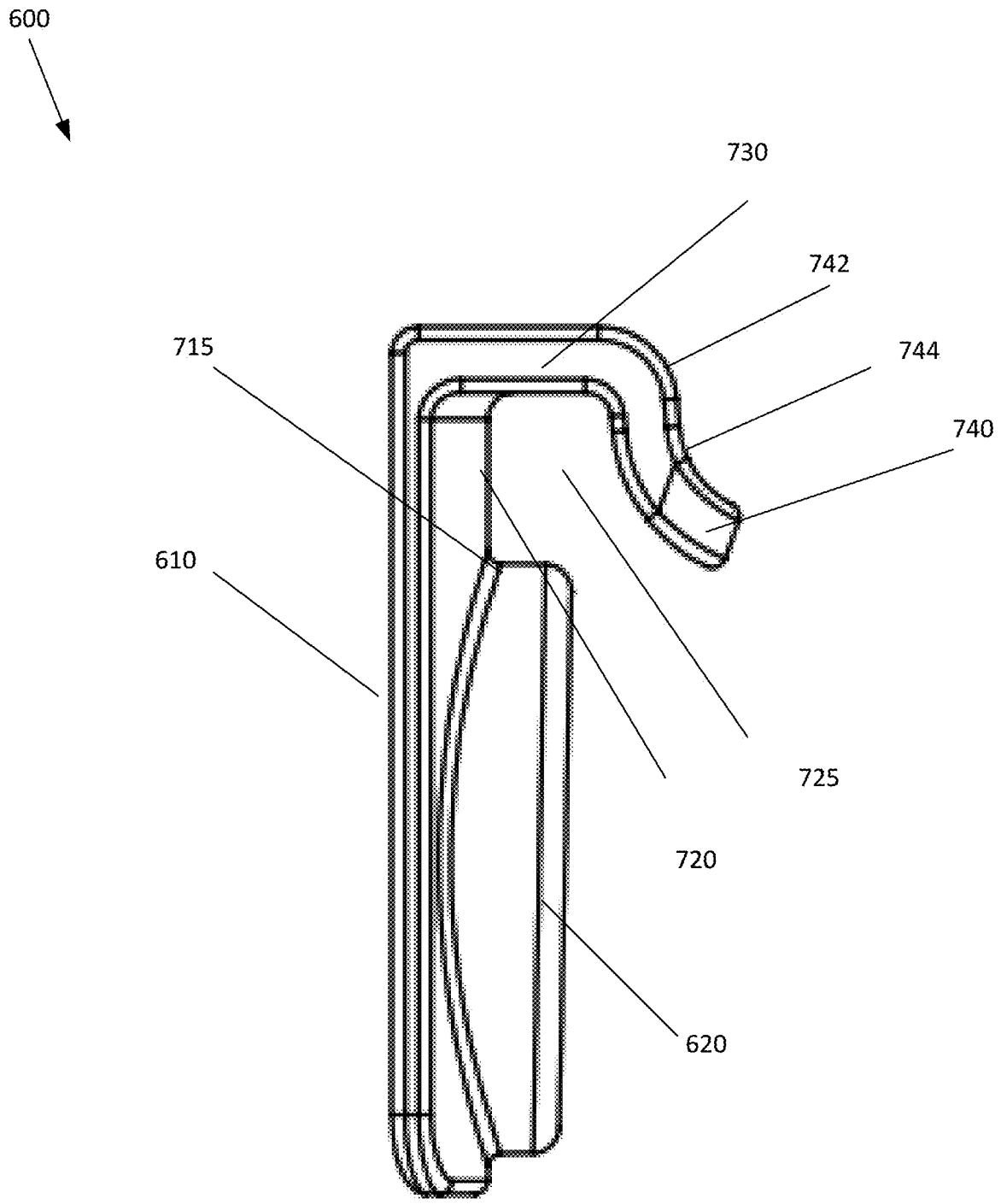

FIG. 7 depicts a side view of elements of second portion 600, according to an embodiment. Elements depicted in FIG. 7 may be described above. For the sake of brevity, a further description of these elements is omitted. As depicted in FIG. 7, second portion 600 may include an inner sidewall 720, overhang 730, and tab 740

In embodiments, a rear surface of projection 620 may be positioned further away from font face 610 than inner sidewall 720. As such, the rear surface of projection 620 may be positioned along a different offset than inner sidewall 720 along a lateral axis of second portion 600. This may expose the outer circumference 715 of projection 620. The relative positioning of the projection 620 and inner sidewall 720 may create a ledge on the curved surface of the projection 620, wherein the curved surface 715 may be positioned adjacent to the sidewalls 130 of depression 120 to increase the surface area between the first portion 100 and second portion 620. In use, inner sidewall 720 may be configured to be positioned adjacent to the first front face 110 of first portion 100 when first portion 100 and second portion 600 are coupled together.

Overhang 730 may be positioned on an upper surface of the second portion 600, and may extend in a plane that is perpendicular the front face 610. Overhang 730 may extend in the same direction as projection 620. Overhang 730 may extend from the inner sidewall 720 past a plane that is vertically aligned with the face of projection 620. This may create a slot 725 that enables portion of the tab 740 to be positioned adjacent to a rear face of the first portion 100, the lip 117 of the first portion 100 to be positioned adjacent to the overhang 730, and projection 620 to be embedded and positioned within the depression 120.

Tab 740 may be positioned on an end of overhang 730, and may be shaped similar to an "S" with a convex curve 742 and a concave curve 744. The curvature of tab 740 may enable a tight fitting between the second portion 600 and the first portion 100, while enabling an end of the overhang 730 to be positioned away from inner sidewall 110 at a position that is lower than the outer circumference of projection 600.

Figure 8:
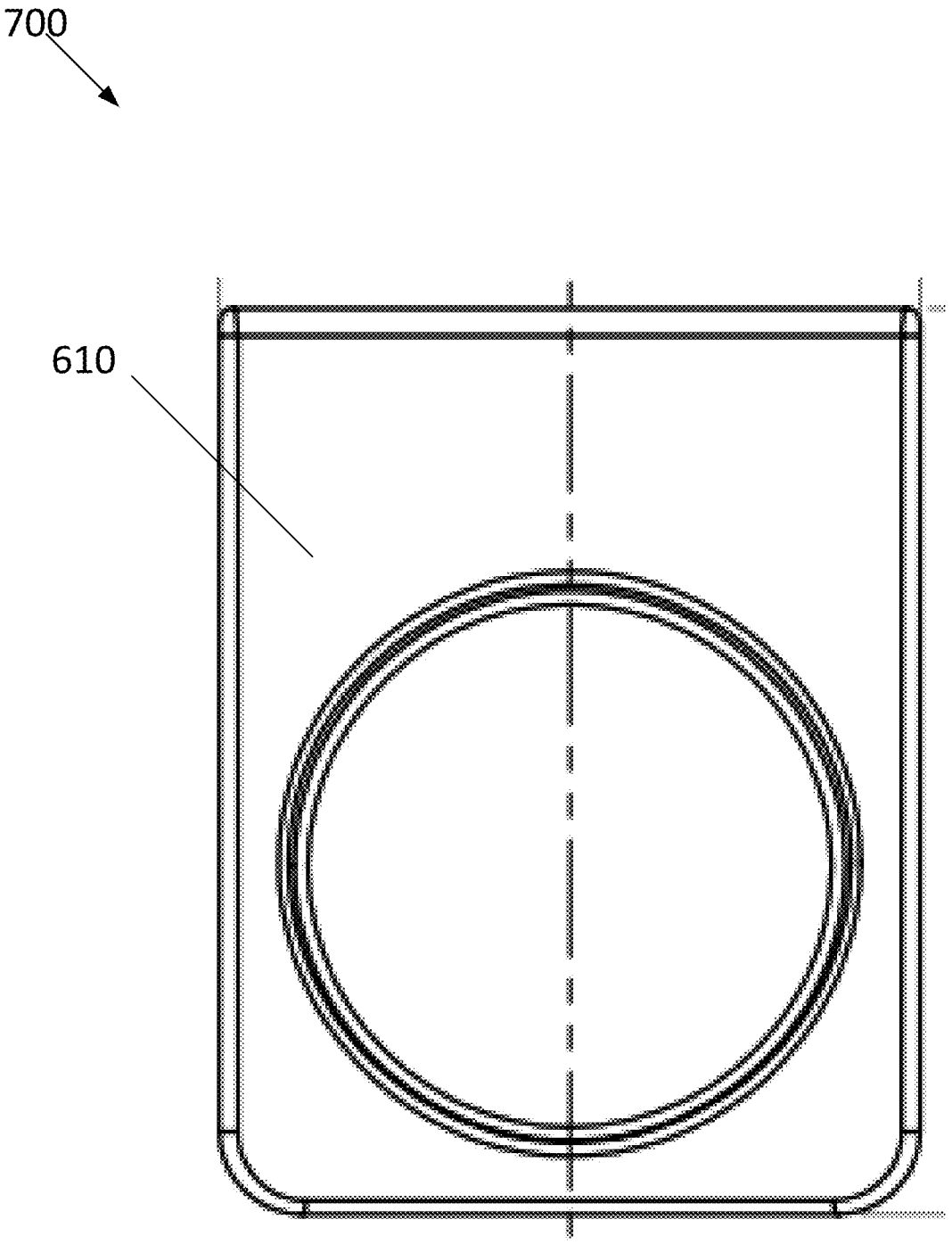

FIG. 8 depicts a front view of elements of second portion 600, according to an embodiment. Elements depicted in FIG. 8 may be described above. For the sake of brevity, a further description of these elements is omitted.

Figure 9:
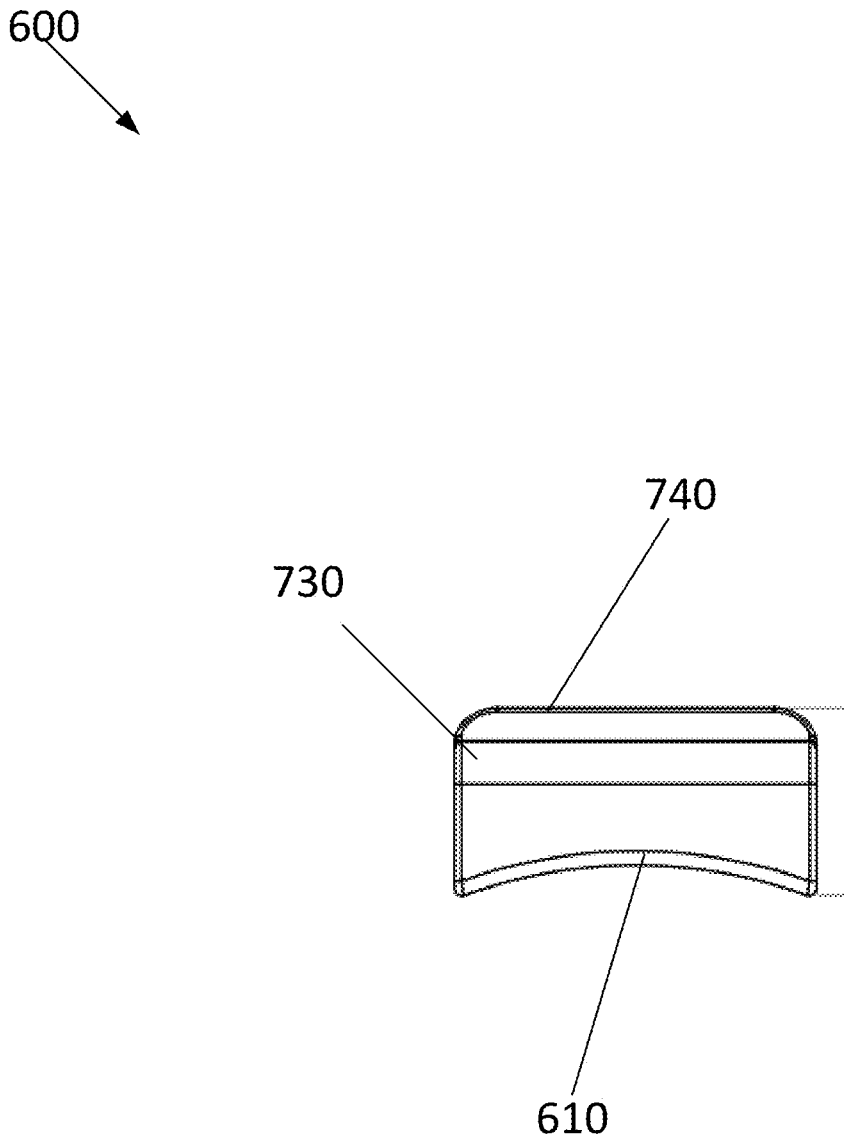

FIG. 9 depicts a top view of elements of second portion 600, according to an embodiment. Elements depicted in FIG. 8 may be described above. For the sake of brevity, a further description of these elements is omitted.

Figure 10:
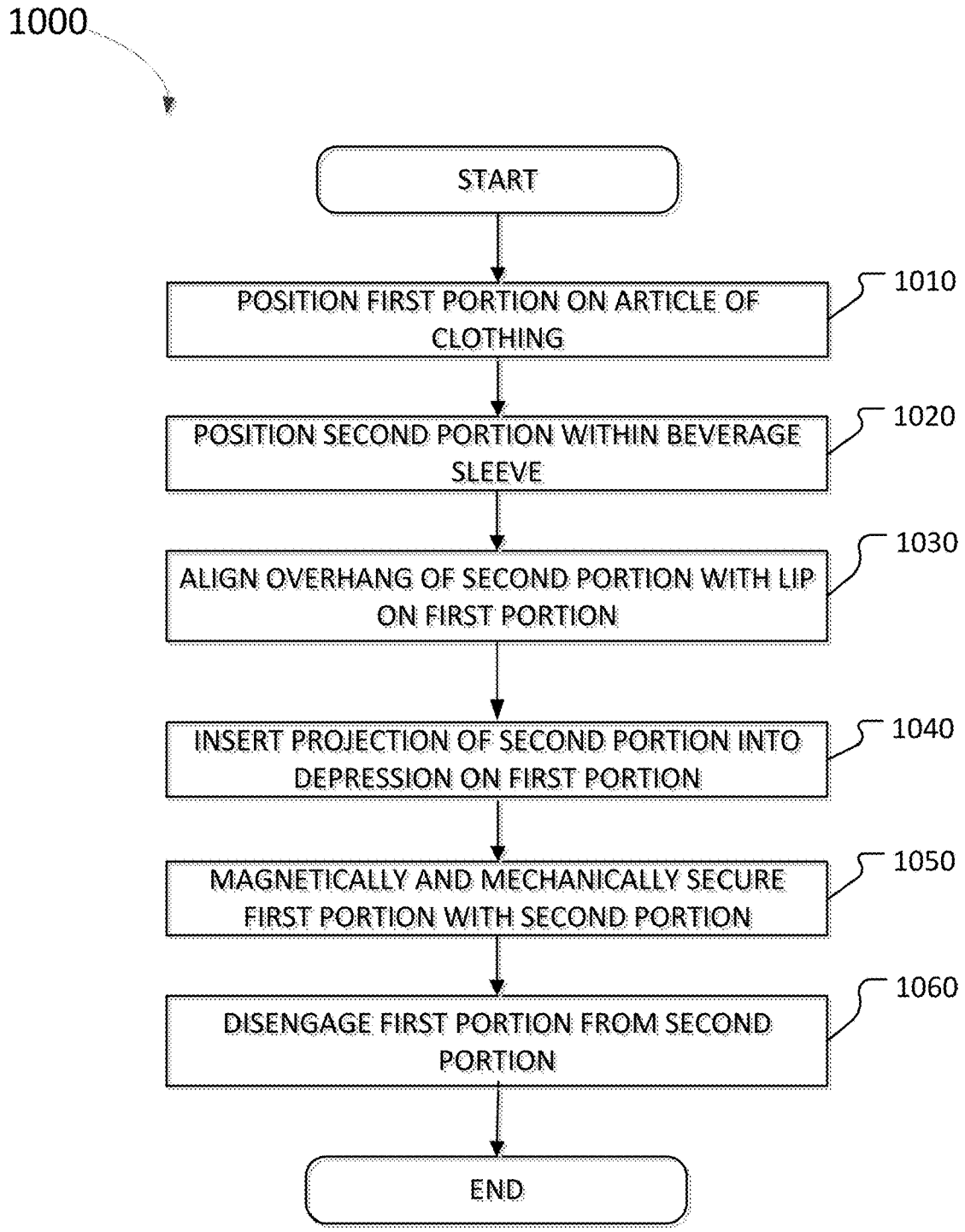
FIG. 10 depicts a method for using a container holder, according to an embodiment.

FIG. 10 depicts a method 1000 for utilizing a container holder, according to an embodiment. The operations of method 1000 presented below are intended to be illustrative. In some embodiments, method 1000 may be accomplished with one or more additional operations not described, and/or without one or more of the operations discussed. Additionally, the order in which the operations of method 1000 are illustrated in FIG. 10 and described below is not intended to be limiting.

At operation 1010, a first portion of the container holder may be coupled to a user's article of clothing. The first portion may be coupled to the user's article of clothing in any known fashion, such as a strap, clip, etc., wherein a planer inner surface of the first portion is direction positioned against the user.

At operation 1020, a second portion of the container holder may be embedded within a beverage sleeve. For example, the second portion may be positioned on the outside of the beverage sleeve or embedded within layers of the beverage sleeve.

At operation 1030, an overhang of the second portion may be positioned over a lip of the first portion. This may mechanically limit the vertical movement of second portion in relation to first portion in a first direction.

At operation 1040, a projection of the second portion may be inserted into a depression of the first portion. The projection may be magnetized to have a first polarity, and the depression may be magnetized to have a second polarity.

At operation 1050, the relative magnetization of the depression and projection may magnetically couple the first portion and second portion in a direction that is orthogonal to the first direction.

At operation 1060, the second portion may be pressed away from the depression to decouple the magnetization of the first and second portion. Further, the second portion may move in a second direction to decouple the mechanically coupling caused by the lip of the first direction and the overhang of the second portion.

Figure 11:
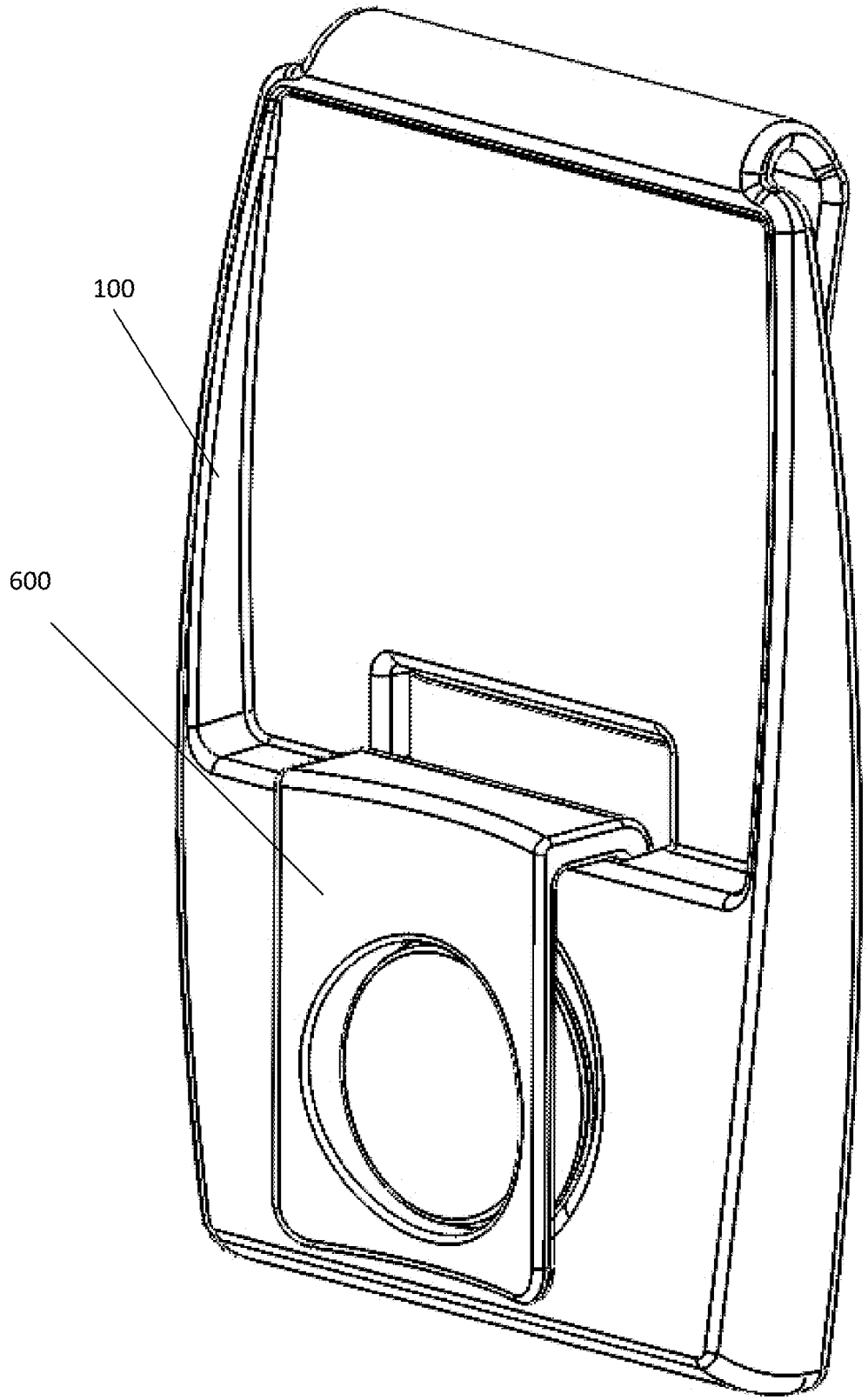
FIG. 11 depicts a first portion of a container holder being coupled with a second portion of a container holder, according to an embodiment.

FIG. 11 depicts a first portion 100 of a container holder being coupled with a second portion 600 of a container holder, according to an embodiment. Elements depicted in FIG. 11 may be described above, and for the sake of brevity a further description of these elements is omitted.

Figure 12:
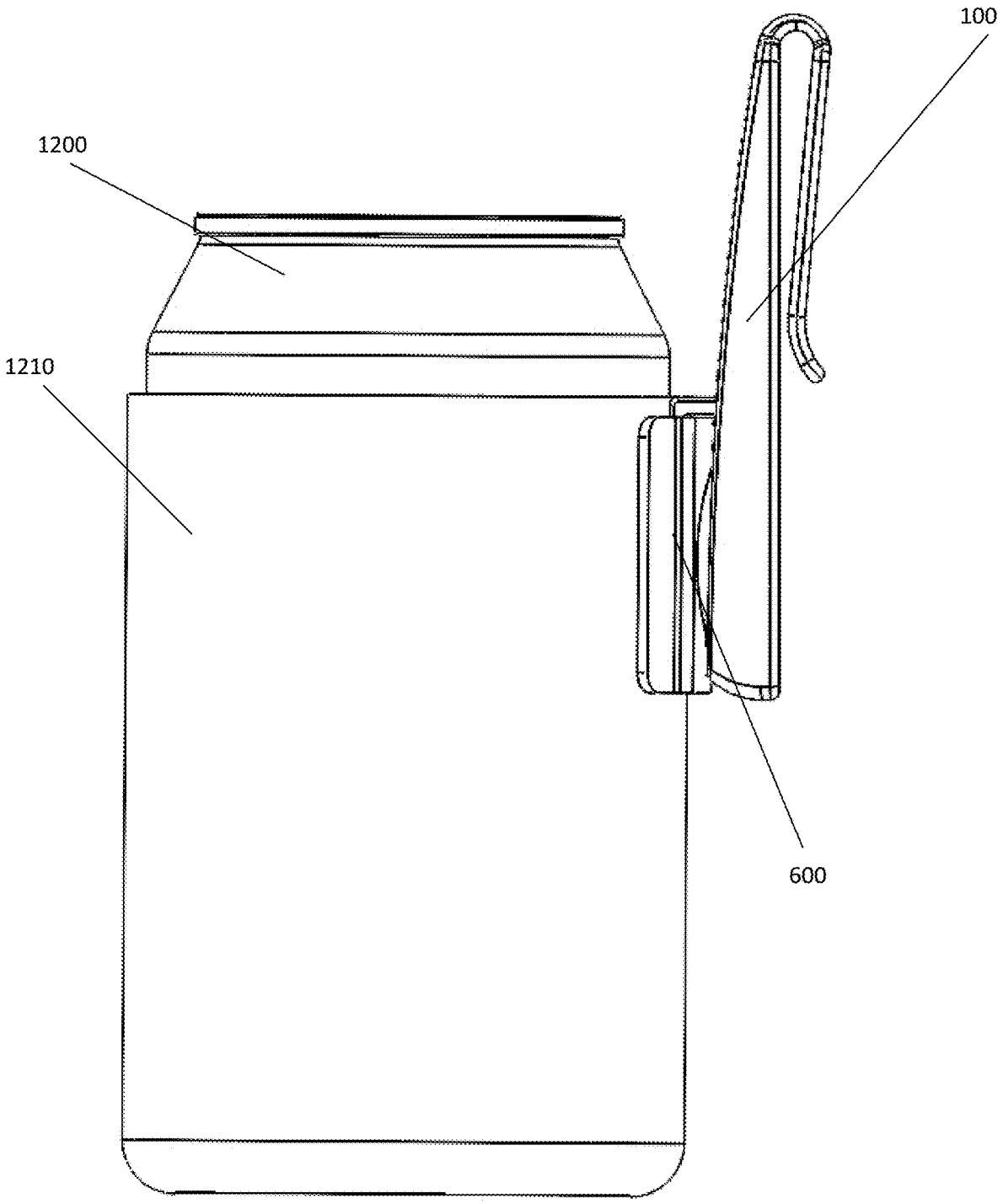
FIGS. 12 and 13 depict a first portion of a container holder being coupled with a second portion of a container holder, according to an embodiment.
Figure 13:
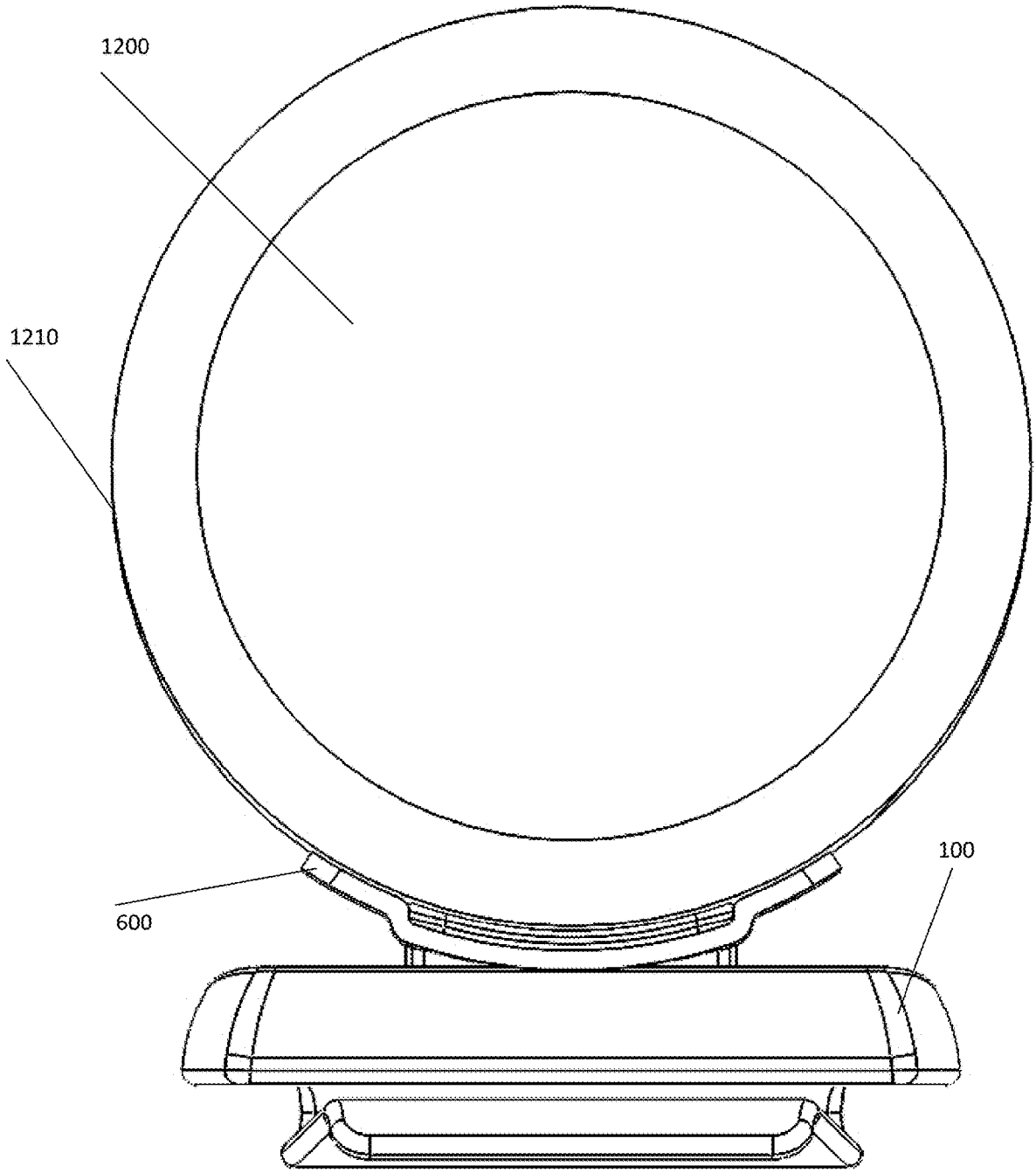

FIGS. 12 and 13 depict a first portion 100 of a container holder being coupled with a second portion 600 of a container holder, according to an embodiment. Elements depicted in FIGS. 12-13 may be described above, and for the sake of brevity a further description of these elements is omitted.

As depicted in FIGS. 12-13 a beverage can 1200 may be positioned within a beverage sleeve 1210. Second portion 600 of the container holder may be coupled with the beverage sleeve 1210, wherein second portion 600 and first portion 100 are coupled together.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A container holder system comprising:

a first portion including a clip, a depression, a first face, a second face, a ledge, and a lip, the clip being configured to be attached and detached from a belt, the depression being an indentation into the first face of the first portion, the ledge extending from the first face to the second face in a plane that is orthogonal to the second face, wherein both the first face and the second face are positioned on an outer surface of the first portion, the lip being an upper edge of the first face and being positioned directly adjacent to the ledge, a first width of the ledge being larger than a second width of the lip, wherein the first width and the second width extend in the plane that is orthogonal to the first face, wherein an outer surface of the depression has a first polarity, wherein the first face is offset from the second face along the plane that is orthogonal to the second face;

a second portion including a projection and an overhang, the projection having an inner face, the overhang having a proximal end and a distal end, the projection having a second polarity and being configured to be inserted into the depression, the overhang being configured to be positioned over the lip, wherein the proximal end of the overhang extends away from an inner sidewall of the second portion, the inner face of the projection extending away from the inner sidewall of the second portion and being positioned between the proximal end of the overhang and the distal end of the overhang, the inner face being positioned closer to the inner sidewall than the distal end of the overhang;

a tab positioned on the distal end of the overhang, the tab including a convex inner curve and a concave inner curve.

2. The container holder of claim 1, further including:

a window, the window being a cutout within a second face of the first portion and a ledge, the ledge being positioned between the first face and the second face.

3. The container holder of claim 1, wherein the proximal end of the overhang portion is positioned closer to an outer surface of the second portion than an inner surface of the projection, and the distal end of the overhang is positioned further away from the outer surface of the second portion than the inner surface of the projection.

4. The container holder of claim 3, further comprising:

an inner sidewall of the second portion is positioned between an outer circumference of the projection and the proximal end of the overhang, and the inner sidewall of the second portion extends in a plane in parallel to the inner surface of the projection.

5. The container holder of claim 1, wherein an inner circumference of the projection is a hollow groove within the outer surface of the second portion, the inner circumference of the projection having varying heights.

6. A method associated with a container holder comprising:

attaching a clip of a first portion of the container holder to a belt worn by a user, the first portion including a depression, a first face, a second face, a ledge, and a lip, the ledge extending from the first face to the second face in a plane that is orthogonal to the second face, wherein both the first face and the second face are positioned on an outer surface of the first portion, wherein the first face is offset from the second face along the plane that is orthogonal to the second face;

positioning a projection associated with a second portion of the container holder into the depression associated with the first portion of the container holder, the projection having an inner face, the depression being an indentation into the first face of the first portion, positioning an overhang associated with the second portion of the container holder over the lip associated with the first portion of the container holder, the overhang having a proximal end and a distal end, the lip being an upper edge of the first face and being positioned directly adjacent to the ledge, a first width of the ledge being larger than a second width of the lip, wherein the first width and the second width extend in the plane that is orthogonal to the first face, wherein an outer surface of the depression has a first polarity, the second portion being embedded within layers of a beverage sleeve, and the projection having a second polarity, wherein the proximal end of the overhang extends away from an inner sidewall of the second portion, the inner face of the projection extending away from the inner sidewall of the second portion and being positioned between the proximal end of the overhang and the distal end of the overhang, the inner face being positioned closer to the inner sidewall than the distal end of the overhang, wherein a tab is positioned on the distal end of the overhang, the tab including a convex inner curve and a concave inner curve.

7. The method of claim 6, further including:

positioning the overhang into a window on the first portion, the window being a cutout within a second face of the first portion and a ledge, the ledge being positioned between the first face and the second face.

8. The method of claim 6, wherein the proximal end of the overhang portion is positioned closer to an outer surface of the second portion than an inner surface of the projection, and the distal end of the overhang is positioned further away from the outer surface of the second portion than the inner surface of the projection.

9. The method of claim 8, wherein an inner sidewall of the second portion is positioned between an outer circumference of the projection and the proximal end of the overhang, and the inner sidewall of the second portion extends in a plane in parallel to the inner surface of the projection.

10. The method of claim 6, wherein an inner circumference of the projection is a hollow groove within the outer surface of the second portion, the inner circumference of the projection having varying heights.

* * * * *